United States Patent [19]

Reneau

[11] Patent Number: 4,541,204

[45] Date of Patent: Sep. 17, 1985

[54] APPARATUS FOR MANUFACTURING SUBSTANTIALLY SPHERICAL OBJECTS TO A HIGH DEGREE OF ROUNDNESS

[76] Inventor: Bobby J. Reneau, 1107 Aldine Mail Rte., Houston, Tex. 77039

[21] Appl. No.: 502,697

[22] Filed: Jun. 9, 1983

[51] Int. Cl.[4] ..... B24B 11/04

[52] U.S. Cl. ..... 51/90; 51/120; 51/289 R

[58] Field of Search ..... 51/43, 90, 119, 120, 51/289 R, 330

[56] References Cited

U.S. PATENT DOCUMENTS

| | | | |
|---|---|---|---|
| 753,911 | 3/1904 | Pelstring | 51/90 |
| 1,662,137 | 3/1928 | Summers | 51/90 X |
| 1,815,336 | 7/1931 | Shelsinger et al. | 51/90 |
| 2,023,572 | 12/1935 | Brendel | 51/90 |
| 2,982,057 | 5/1961 | Stanhope | 51/289 R X |
| 3,111,789 | 11/1963 | Harmon | 51/90 X |
| 4,361,987 | 12/1982 | Lapsker | 51/90 |

FOREIGN PATENT DOCUMENTS

| | | | |
|---|---|---|---|
| 8896 | 1/1978 | Japan | 51/289 R |
| 497412 | 3/1937 | United Kingdom | 51/90 |

*Primary Examiner*—Robert P. Olszewski

*Attorney, Agent, or Firm*—Pravel, Gambrell, Hewitt & Kimball

[57] ABSTRACT

An apparatus for machining spherical objects to a high degree of roundness. The apparatus includes rotating a work piece about a first axis and concurrently rotating a grinding device about a second axis perpendicular to the first axis to engage the work piece. The grinding device includes a plurality of grinding wheels which rotate about a third axis radially extending from second axis.

3 Claims, 4 Drawing Figures

APPARATUS FOR MANUFACTURING SUBSTANTIALLY SPHERICAL OBJECTS TO A HIGH DEGREE OF ROUNDNESS

FIELD OF THE INVENTION

The field of the invention relates generally to an apparatus for forming spherical objects from a work piece.

BACKGROUND OF THE INVENTION

The desirability of imparting a uniformily spherical surface to a work piece has long been appreciated. Exemplary of the need for such a uniformly spherical surface is the rotating flow control ball of a ball valve. Ball valves typically have a flow control ball having a substantially spherical surface and a flow control port bored therethrough. Diametrically opposed trunnions are formed with the flow control ball so as to rotate the flow control ball therein between an open and close position. Typically, the substantially spherical surface is sealably engaged by seals mounted on the ball valve body. While it is well known to manufacture such flow control balls to a substantially spherical shape, it has been found difficult to completely machine the flow control ball to a high degree of roundness. Moreover, such non-uniformity in roundness permits dirt, grime and grit to work its way between the flow control ball and the valve body or seals to scar the surface and further increase its spherical nonuniformity to damage seals and generally to increase repair frequency of such valves.

Presently it is believed that substantially spherical surfaces are imparted to ball valves and the like in a three-step process comprising machining, grinding and lapping. A roughly spherical form can be obtained by use of a lathe or the like. Next, the roughly spherical object is mounted such that it rotates about its longitudinal axis. A grinding stone is positioned in a plane containing the longitudinal axis of the object and the grinding stone is oscillated about a radius of gyration having its origin on the longitudinal axis of rotation of the object. The grinding stone oscillates within a predetermined arc to form a substantially spherical surface on the object being rotated. Finally, the object is hand lapped with a rubbing compound or the like to obtain a surface which is substantially spherical with a tolerance of 0.001 inches. The final two steps of grinding and lapping are also used to rework previously manufactured flow control balls having a worn or abraded spherical surface.

SUMMARY OF THE INVENTION

The apparatus of the present invention for manufacturing spherical objects includes means for rotating a work piece about a first axis and grinding means rotating about a second axis perpendicularly to the first axis to engage the work piece to form a uniformly spherical surface thereon. The grinding means includes at least one grinding wheel rotating about a third axis extending radially from the second axis. The apparatus of the present invention provides for an improved apparatus for forming a spherical surface having a higher degree of uniformity heretofore known in the prior art.

DESCRIPTION OF THE PREFERRED EMBODIMENT

Figure 1:
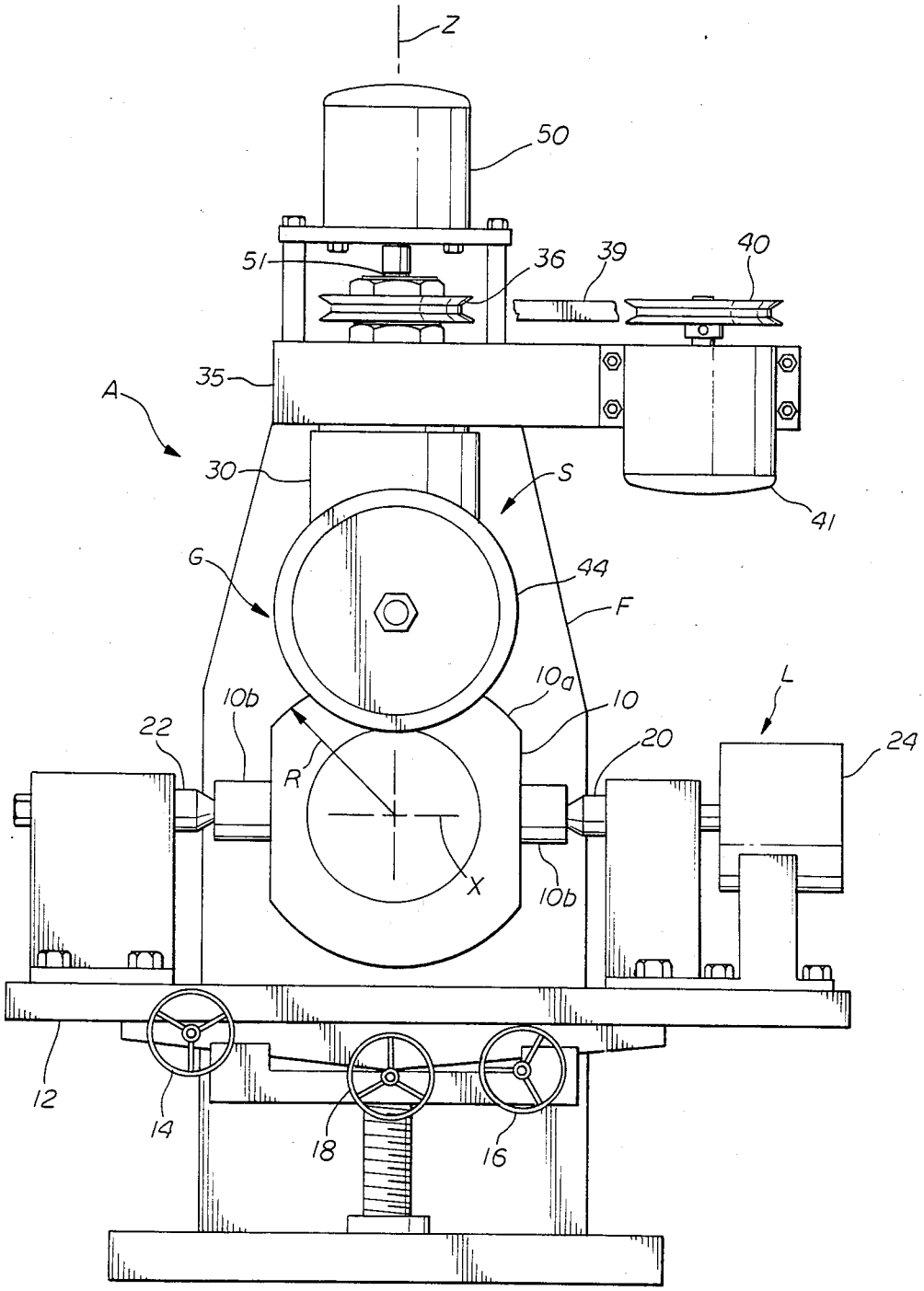
FIG. 1 is an elevational view of an apparatus.
Figure 2:
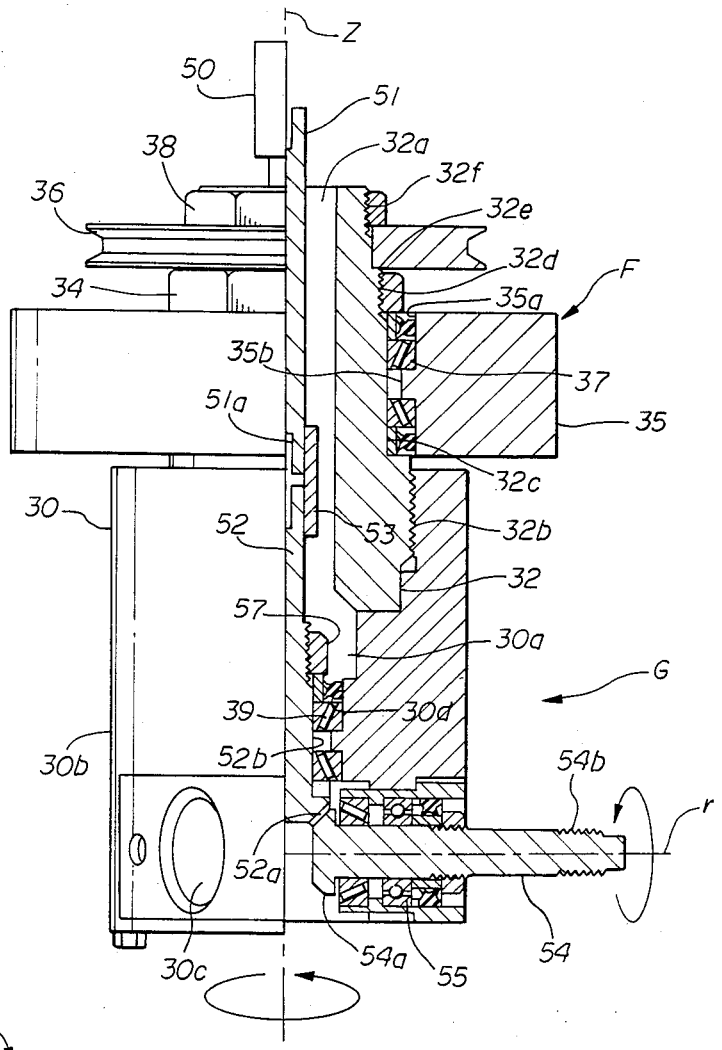
FIG. 2 is an elevational, fragmentary view of the grinding housing.
Figure 3:
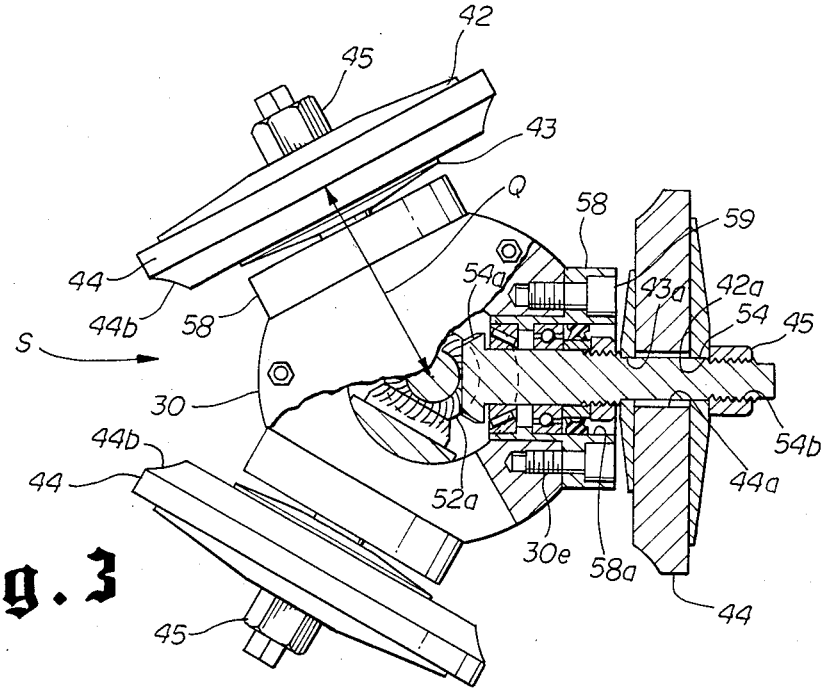
FIG. 3 is a plan, partially fragmentary view of the grinding head.

The apparatus of the present invention is shown in FIGS. 1 to 3 and is generally designated by the letter A.

The apparatus A of the present invention for forming a uniformly spherical surface on a work piece 10 includes a frame F and rotation means L mounted with the frame F for supporting the work piece 10 and for rotating the work piece 10 about its longitudinal axis X. The apparatus A of the present invention further includes a grinding means G mounted with the frame F for rotation about an axis Z perpendicular to the longitudinal axis X of work piece 10 and for engaging the work piece 10 to form a uniformily spherical surface 10*a* thereon.

Looking first at FIG. 1 it is seen that frame F includes a rigid support table 12 as well as conventional means 14, 16 and 18, respectively, for triaxial movement wherein the support table 12 can be moved left or right, in or out, and up or down. Frame F in FIG. 1 is shown to be a standard vertical milling machine although those skilled in the art will appreciate that other conventional apparatus having a rigid support table with triaxial adjustment are comprehended.

Rotation means L is detachably mounted with support table 12. Rotation means L includes spindles 20, 22 secured to table 12. Spindles 20, 22 are adapted to be positioned a spaced distance apart one from the other and in alignment along axis X to rotatably receive work piece 10. The work piece 10 includes trunnions 10*b* which engage spindles 20, 22 so as to align the work piece 10 with the longitudinal axis X of rotation of spindles 20, 22.

The rotation means L further includes a motor 24 mounted on table 12 and operably connected to spindle 20 so as to rotate work piece 10 about the longitudinal axis X. Motor 24 is a low speed electric motor having means for adjusting its speed of rotation. In the preferred embodiment the motor 24 imparts a rotational speed of approximately 6 rpm to the work piece 10.

The work piece 10 mounted with spindles 20, 22 is shown in FIG. 1 to be a flow control ball for a ball valve, although it is understood by those skilled in the art that other objects could be placed within spindles 20, 22 to form a spherical surface thereon. The work piece 10 as seen in the elevational view of FIG. 1 has a longitudinal axis also designated as X which is aligned with the longitudinal axis of rotation of spindles 20, 22. The work piece 10 has an exterior surface 10*a* having an approximate radius of curvature R which intersects the longitudinal axis X.

Grinding means G is operably mounted with frame F, which includes a support arm 35 mounted with the frame and extending laterally from the main part thereof. The grinding means G includes a housing 30 having a grinding head S operably attached thereto. The housing 30 is a generally cylindrical member having a central cavity 30*a* as seen in FIG. 2. About the lower end 30*b* of housing 30 are a plurality of bores 30*c* extending radially inwardly to central cavity 30*a*.

A hollow shaft 32 having a longitudinal bore 32*a* threadably engages housing 30 making a threaded connection 32*b*. The longitudinal passageway 32*a* of shaft 32 communicates with central cavity 30*a* of housing 30. The hollow shaft 32 includes a series of stepped, cylindrical surfaces 32*b, c, d, e* and *f* from largest to smallest diameter. The shaft 32 includes a journalled surface 32*c* having a predetermined diameter. Shaft 32 is rotatably mounted with frame F such that journalled surface 32*c* is rotatably aligned with opening 35*a* of support arm 35 of the frame F. A plurality of bearings 37 are annularly disposed between the journaled surface 32*c* and interior surface 35*b* of opening 35*a*.

Shaft 32 further includes the threaded portion 32*d* extending above support arm 35 and is threadably engaged with a retaining nut 34. Shaft 32 also includes a shoulder 32*e* sized to receive a pulley 36, which is mounted on shaft 32 by a key or other suitable means at shoulder 32*c* for rotation with the shaft. Shaft 32 further includes a threaded surface 32*f* extending a predetermined distance above pulley 36 to accept a threaded retaining member or nut 38 to securely locate pulley 36 with shaft 32.

As seen in FIG. 1 pulley 36 is operably connected by way of drive belt 39 to a drive pulley 40 which is driven by a power source 41 mounted on support arm 35. It is understood by those skilled in the art that other means of operably driving shaft 32 are available. Thus motor 41 through the belt drive of pulleys 36 and 40 rotates hollow shaft 32 and hollow grinding housing 30 mounted thereon.

The grinding means G further includes the grinding head S having a plurality of grinding stones or wheels 44 mounted with the housing 30. The grinding head S is mounted in the bottom of hollow housing 30 and mounts three spaced grinding wheels 44 for rotation independent of rotating head 30. The grinding head S is operably connected to a motor 50 for rotational movement. The operable connection between grinding head S and motor 50 includes a shaft 51 operably connected with motor 50 and extending longitudinally through passageway 32*a* of shaft 32. Shaft 51 has a splined lower end 51*a* adapted for detachable connection as will be further explained. A shaft 52 is rotatably mounted within the central cavity 30*a* of housing 30. Shaft 52 has a planetary beveled driving gear 52*a* at one end thereof. At the opposite end of shaft 52*a* a sleeve 53 is securely mounted therewith. Shaft 52 is longitudinally aligned with shaft 51 and sleeve 53 has an interior passageway sized to slidably engage the splined end 51*a* of shaft 51 so as to transmit rotary motion from motor 50 and shaft 51 to shaft 52.

The central cavity 30*a* has an internal mounting surface 30*d* mounting bearings 39. Shaft 52 includes a journalled surface 52*b* longitudinally aligned with the bearings 39. The bearings 39 are interposed between shaft surface 52*b* and mounting surface 30*d* to mount shaft 52 for rotational movement independent of the rotation of housing 30. A threaded nut 57 is mounted with shaft 52 to maintain the proper alignment of shaft 52 with housing 30.

A shaft 54 is mounted in each bore 30*c* of housing 30. Each shaft 54 has an internal beveled gear end 54*a* adapted to rotatably engage the planatary beveled drive gear 52*a* of shaft 52. Shaft 54 is rotatably mounted within bore opening 30*c* having bearings 55 interposed between shaft 54 and bore opening 30*c* to reduce the resistance to rotational friction. As best seen in FIG. 3 a cover plate 58 having a central opening 58*a* is adapted to slide over shaft 54 and to be securely mounted with housing 30 with a plurality of bolts 59 which threadably engage housing 30 in threaded bores 30*e*.

The grinding stones or wheels 44 have a central opening 44*a* which is adapted to receive shaft 54. Holding plates 42 and 43 each having a central opening 42*a* and 43*a*, respectively, are mounted on either side of grinding stone 44 to securely attach grinding each stone 44 with shaft 54. Shaft 54 also includes a threaded end 54*b* adapted to receive a threaded nut 45 to securely hold grinding stone 44 and holding plates 42, 43 with shaft 54. Grinding stone 44 is circular in configuration and as seen in FIG. 1, while in cross-section grinding stone 44 includes a beveled surface 44*b* about its circumference.

METHOD OF OPERATION

The work piece 10 is mounted with spindles 20, 22 such that the longitudinal axis X of the work piece coincides with axis of rotation of spindles 20, 22. Thereafter, triaxial movement means 14 and 16 of frame F are operated so as to align the axis of rotation Z of housing 30 and grinding head S such that it is perpendicular to the axis X and is coincident with the geometric center proscribed by radius R of work piece 10 as shown schematically in FIG. 4. The work piece 10 is then elevated into grinding engagement with grinding stones 44 such that interior beveled surface 44*b* engages outer surface 10*a* of the work piece 10. With motor 24 energized, the work piece 10 is rotated about longitudinal axis X at a slow speed of rotation. The motor 24 is preferably of the type which can be operated at various slow speeds of approximately five to fifteen RPM depending on the diameter of the work piece. Next, the motor 41 is energized to rotate housing 30 and attached grinding head S about axis Z at a speed substantially greater than that of work piece 10. The axis of rotation Z of housing 30 and grinding head S is coincident with the longitudinal axis of shafts 32, 51 and 52. It is understood by those skilled in the art that grinding head S must have a rotational speed sufficiently greater than work piece 10 to insure that the grinding engagement of grinding head S with work piece surface 10*a* provides complete coverage of such surface to avoid differential grinding on various portions of surface 10*a*. Differential grinding on surface 10*a* can lead to a repetitive pattern or grooving of the surface 10*a* which is highly undesirable. The ratio of speeds of rotation about the Z to X axis can be decreased as the number of grinding stones 44 rotatably mounted with grinding head S increases.

Figure 4:
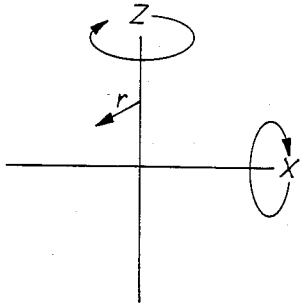
FIG. 4 is a schematic representation of the axes of rotation of the grinding device and work piece.

Grinding stones 44 are rotated by motor 50 about axis r which extends radially from axis Z. Motor 50 is a high speed motor designed to rotate grinding stones 44 for optimum grinding engagement. It is understood by those skilled in the art that with the direction of rotation about axes X and Z fixed that grinding stone 44 may be rotated in either direction about axis r. However, when grinding stone 44 rotates clockwise as seen in FIG. 4 at a predetermine speed its relative grinding speed of rotation with respect to surface 10*a* is increased. Conversely, rotating the grinding stones 44 in a counterclockwise direction will produce a decreased relative speed of grinding rotation with respect to surface 10*b*. At least one grinding stone is required but as the radius R of the work piece 10 increases, additional grinding stones 44 may be added to the grinding head S.

The radius R achieved by grinding head S is equal to radial distance Q from the longitudinal axis Z of grinding head S and housing 30 to the beveled surface 44*b* of grinding stones 44. The beveled surface 44*b* need not initially be contoured to correspond with radius R of work piece 10; since through the cooperative rotary motions about axes X, Z and r, the beveled surface 44*b* will be ground to have a radius of curvature equal to the radius R when it engages exterior surface 10*b*. In this manner, the surfaces 44*b* of the grinding stones or wheels 44 are approximately tangential to the desired spherical surface 10*a* of the work piece 10. While many prior art machines have the capability of machining spherical objects, the apparatus A is particularly advantageous for producing a refined spherical surface with excellent roundness.

The foregoing disclosure and description of the invention are illustrative and explanatory thereof, and various changes in the size, shape and materials, as well as in the details of the illustrated construction may be made without departing from the spirit of the invention.

I claim:

1. An apparatus for imparting a substantially uniform spherical shape to the sealing surface of a ball valve flow control ball having diametrically opposed trunnions formed thereon coincident with a longitudinal axis through the geometric center thereof, and having a flow control port bored therethrough transverse to the longitudinal axis, comprising:

means for rotating the ball about its longitudinal axis;

a grinding head rotatable about a second axis perpendicular to the longitudinal axis of the ball and coincident with the geometric center thereof;

means for rotating said grinding head;

a plurality of shafts mounted with said grinding head and extending therefrom radially from a common point on said second axis, said shafts rotatable about their longitudinal axes;

means for rotating said shafts about their said longitudinal axes;

a grinding wheel mounted on each of said shafts a predetermined radial distance from said second axis, said wheels each having a beveled grinding surface facing said second axis for tangentially engaging the surface of the ball and each being rotatable with said shaft; and means for positioning said ball in grinding engagement with said beveled grinding surfaces of said grinding wheels with said second axis perpendicular to the longitudinal axis of the ball while simultaneously rotating the ball about the longitudinal axis thereof, rotating said grinding head about said second axis, and rotating said grinding wheels and said shafts about the longitudinal axes thereof.

2. The apparatus of claim 1, wherein said grinding head is a cylindrical housing having a cavity formed therein and a plurality of bores corresponding with said shafts and extending radially inwardly to said cavity, wherein ends of each of said shafts extend through said bores into said cavity and each said end has an internal beveled gear, and wherein a planetary beveled drive gear in said cavity rotatably engages said internal beveled gears.

3. A method of imparting a substantially uniformly spherical shape to the sealing surface of a ball valve flow control ball having diametrically opposed trunnions formed thereon coincident with a longitudinal axis through the geometric center thereof, and having a flow control port bored therethrough transverse to the longitudinal axis, comprising the steps of:

rotating the ball about its longitudinal axis;

rotating a grinding head about a second axis perpendicular to the longitudinal axis of the ball and coincident with the geometric center thereof, said grinding head having a plurality of shafts extending radially from a common point on said second axis and having a grinding wheel with a beveled grinding surface facing said second axis mounted on each shaft a predetermined distance from said common point;

rotating said grinding wheels about the longitudinal axes of said shafts; and positioning said rotating ball into grinding engagement with said beveled grinding surface of said rotating grinding wheels of said rotating head.

* * * * *